United States Patent [19]

Lindström

[11] Patent Number: 4,657,637

[45] Date of Patent: Apr. 14, 1987

[54] PULP TREATMENT APPARATUS HAVING LOWERABLE VACUUM CONTAINERS TO FACILITATE REMOVAL THEREOF

[75] Inventor: Alf I. Lindström, Sundsbruk, Sweden

[73] Assignee: Sunds Defibrator Aktiebolag, Sweden

[21] Appl. No.: 775,585

[22] Filed: Sep. 13, 1985

[30] Foreign Application Priority Data

Sep. 17, 1984 [SE] Sweden ..... 8404655

[51] Int. Cl.[4] ..... D21D 1/40; D21F 7/00

[52] U.S. Cl. ..... 162/272; 68/205 R; 162/308; 210/400

[58] Field of Search ..... 162/60, 308, 272, 273, 162/199; 68/205 R; 210/241, 400, 401

[56] References Cited

U.S. PATENT DOCUMENTS

| | | | |
|---|---|---|---|
| 1,520,659 | 12/1924 | McDonnell | 162/272 |
| 1,599,385 | 9/1926 | Pryor | 162/308 |
| 1,869,789 | 8/1932 | Williams | 162/272 |
| 2,073,654 | 3/1937 | Smiley | 162/308 |
| 2,799,209 | 7/1957 | Wisner et al. | 162/273 |
| 4,014,736 | 3/1977 | Sexton | 162/60 |
| 4,154,644 | 5/1979 | Ericsson | 162/60 |

*Primary Examiner*—S. Leon Bashore
*Assistant Examiner*—K. M. Hastings
*Attorney, Agent, or Firm*—Lerner, David, Littenberg, Krumholz & Mentlik

[57] ABSTRACT

The apparatus comprises a stand with two end rolls, over which an endless perforated steel web runs. A head box for the pulp is located at the first end roll, and a device for picking-up the treated pulp is located at the second end roll. Along the web means are provided for supplying treatment liquid to the pulp layer. Beneath the web, in the stand vacuum containers are attached detachably for receiving liquid. These containers are individually lowerable and in lowered position movable in the longitudinal direction of the web. The stand further is designed to permit the removal in lateral direction of a container lowered in this way.

8 Claims, 2 Drawing Figures

PULP TREATMENT APPARATUS HAVING LOWERABLE VACUUM CONTAINERS TO FACILITATE REMOVAL THEREOF

BACKGROUND OF THE INVENTION

This invention relates to an apparatus for the liquid treatment of pulp, comprising a stand with two end rolls over which an endless liquid-permeable web runs. A head box for pulp supply is located at one end of the web, and pick-up means for the treated pulp are located at the other end of the web. Means for the supply of treatment liquid to the pulp are provided above the web, and a plurality of containers for collecting the liquid are suspended in the stand beneath the web. These containers extend in the transverse direction along the entire width of the web.

The web can consist of a wire or a perforated web, for example a steel web, which is driven by one end roll and which slides over perforated covers on containers therebeneath in which vacuum prevails.

When using a wire, which usually is manufactured of plaited individual plastic wires, in the case of damage the entire wire must be exchanged. This means, that it must be possible to pull out the entire wire to all its width in lateral direction. This implies that corresponding space must be available to the side of the liquid treatment apparatus. As these apparatuses have great dimensions, for example may have a width of 6 m and a length of 30 m, they require very much space. The containers beneath the web, moreover, must be removable for cleaning and repair, which also requires corresponding space.

When using a web in the form of a perforated steel web, the mounting and dismantling require less space, because the web can be assembled by welding when it is in place in the apparatus. No space, therefore, is required to the side of the apparatus for exchanging the web, but the removal of the containers still requires space to the side of the apparatus, so that the apparatus requires as much space as if a wire had been used. The present invention solves the aforesaid problem. The apparatus, thus, substantially does not require space beyond that required for its own length and width. This is achieved in that the invention has been given the characterizing features defined in the attached claims.

SUMMARY OF THE INVENTION

In accordance with the invention, there is described an apparatus for liquid treatment of pulp, comprising a stand with two end rolls, over which an endless liquid-permeable web in the form of a perforated steel web runs, a head box for the pulp, means above the web for the supply of treatment liquid to the pulp, and a plurality of containers suspended in the stand for collecting liquid on the lower side of the web, which containers extend in the transverse direction in the entire width of the web, characterized in that the containers can be lowered individually and in lowered position be moved in the longitudinal direction of the web, and that the stand is designed so as to permit the removal of a lowered container in lateral direction in relation to the web.

In accordance with another embodiment of the invention, there is disclosed an apparatus for liquid treatment of pulp. The apparatus is constructed of a stand, a liquid-permeable web having a longitudinal axis, means for supporting the web within the stand, means for supplying pulp to the web, and a plurality of containers arranged in an upper position adjacent an underlying portion of the web for collecting liquid penetrating the web, the containers extending transversely of the longitudinal axis of the web and across substantially the entire width thereof, the containers individually lowerable from the upper position to a lower position movable along the longitudinal axis of the web to a predetermined location within the stand, the stand being constructed and arranged to permit the movement of the containers when in the lower position along the longitudinal axis of the web and the removal of the containers from the stand at the predetermined location.

BRIEF DESCRIPTION OF THE DRAWINGS

The invention is described in greater detail in the following, with reference to the embodiment illustrated in the accompanying drawings, in which.

DETAILED DESCRIPTION

Figure 1:
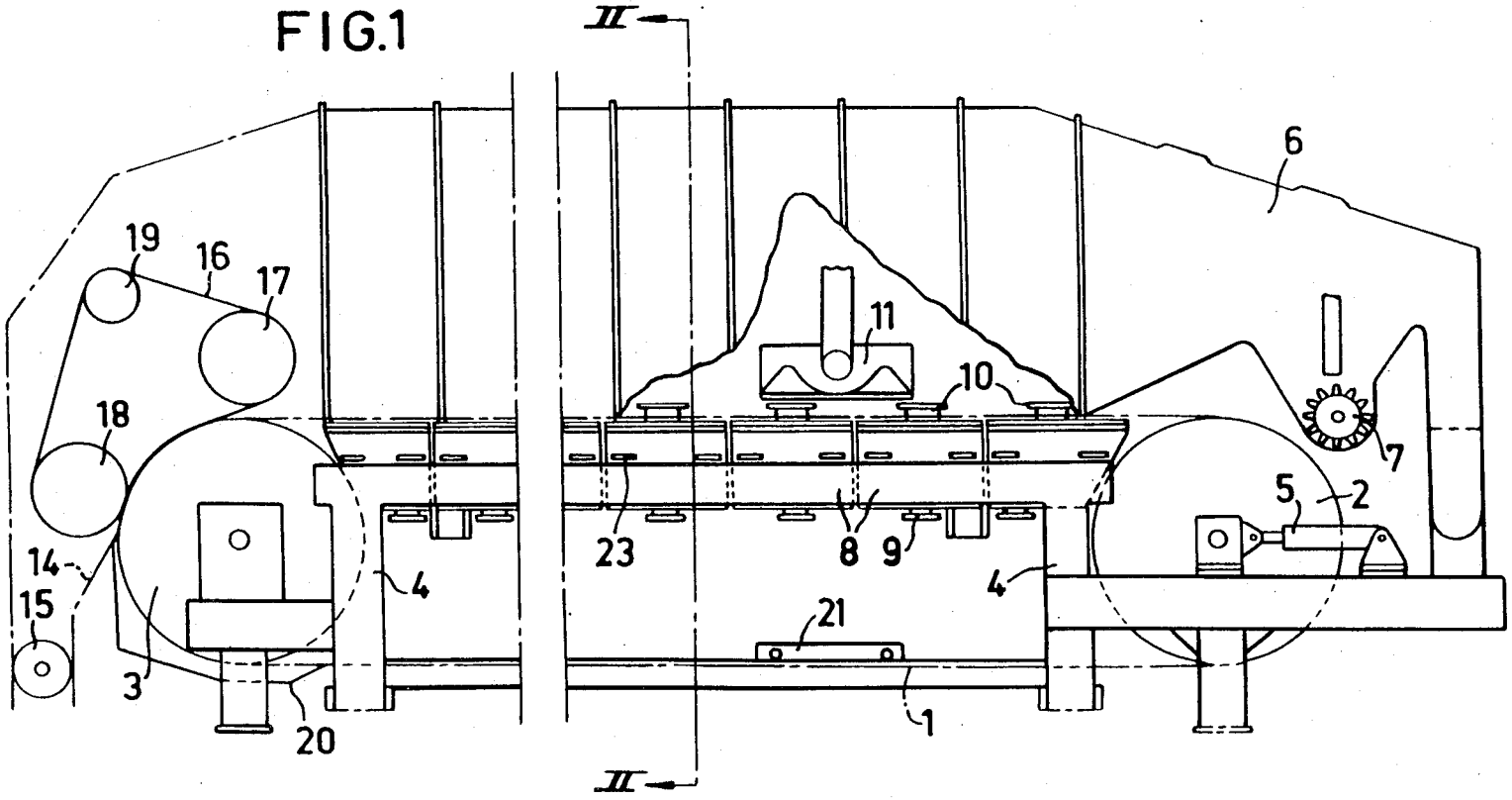
FIG. 1 shows a liquid treatment apparatus according to the invention.
Figure 2:
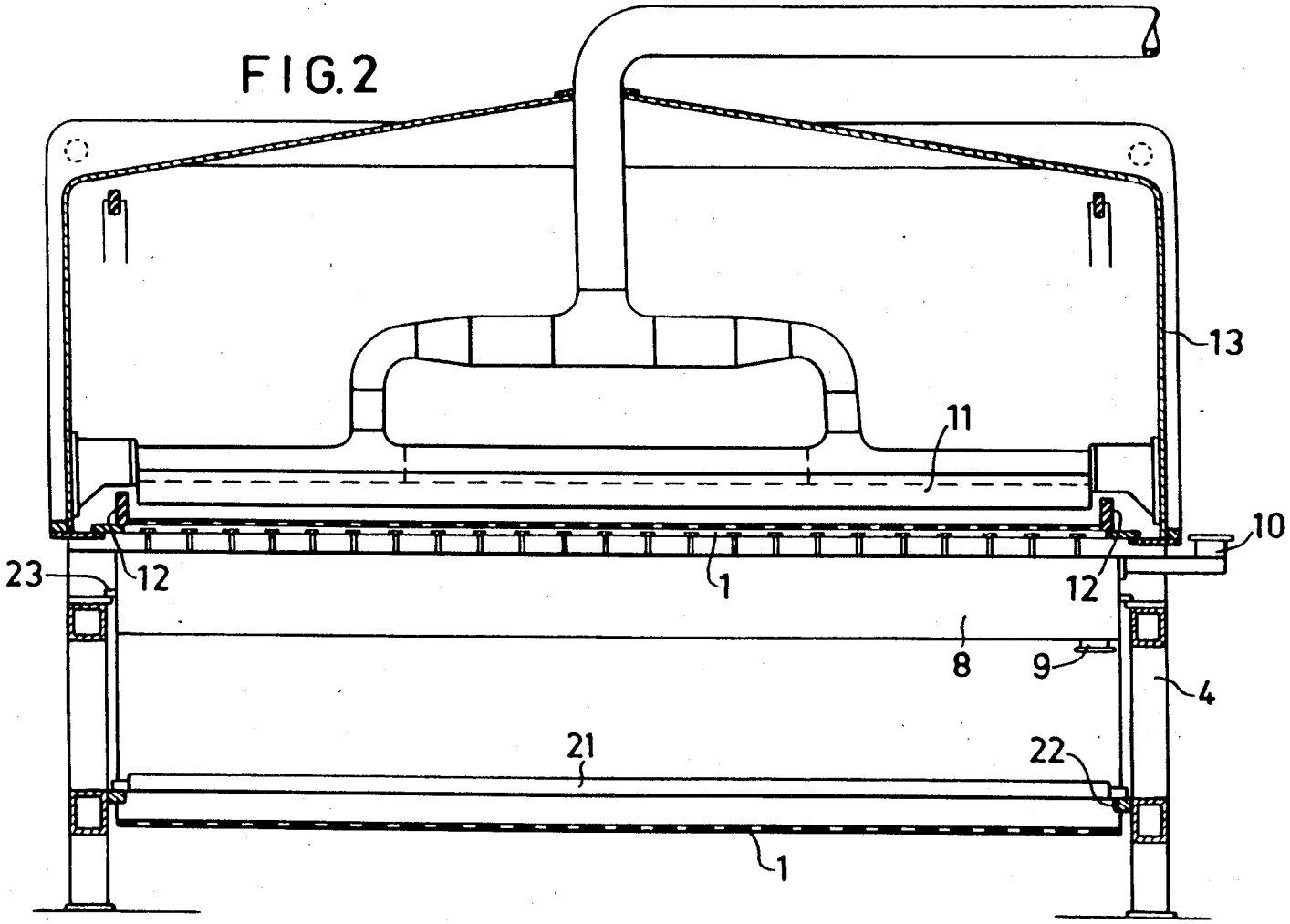
FIG. 2 is a cross-section along line II—II in FIG. 1.

The illustrated embodiment of the apparatus comprises an endless perforated steel web 1, which runs about a first and second end roll 2 and 3, respectively, which are mounted in a stand 4, so that the first roll 2 is movable by means of a preferably hydraulic stretching device 5 for adjusting the web tension. The driving is effected via the second roll 3, and both rolls preferably are coated with a friction-increasing surface layer.

At the first roll 2 a head box 6 is located for distributing the cellulose pulp to a uniform layer on the web 1. In the head box a rotor 7 is provided for deflocculating the pulp. Beneath the web a plurality of vacuum containers 8 are arranged one after the other in the longitudinal direction of the web. The containers are provided with perforated covers for supporting the web 1. Outlets 9 and 10 respectively, are connected to the containers 8 for respectively removing liquid and gas. Above the web 1 is located means 11 for the supply of treatment liquid. Above the pulp layer a pressure difference is maintained for effecting the transport of liquid transversely through the pulp layer. The width of the pulp layer on the web is restricted by two endless deckel straps 12, which follow along with the web 1. Other means for restricting the width, of course, can be imagined. A hood 13 is positioned over the web.

At the second roll 3 a device 14, for example in the form of a doctor, is located for picking up the pulp layer after its treatment is completed. Beneath the device 14 a conveying screw 15 is provided for transporting the pulp to subsequent processing steps. Co-operating with the second roll 3 also are means for pressing-off liquid from the pulp layer. These means, according to the embodiment shown, consist of a water-permeable web 16, which is held pressed against the steel web 1. The web 16 runs over two small rolls 17,18 and a tension roll 19. The second end roll 3 is provided with all around grooves to permit liquid to be pressed-off through the steel web 1. The liquid pressed-off is collected in a trough 20 beneath the end roll 3. Other types of press-off means, of course, can be used. The press-off implies that a high dry content of the pulp can be obtained. The pulp concentration, for example, can be increased at this press-off from about 8% to about 30%. This implies that a greater than normal portion of the chemical content of the pulp can be removed already in connection with liquid treatment. It is possible to reduce a chemical content of 6–10% at a conventional foudrinier wire wash to 1–3%. It is hereby possible, for example, to transport the pulp from the treatment apparatus directly to the bleach plant without additional dewatering in special thickeners.

The steel web used preferably will have a thickness of 0.5–1.5 mm. The diameter of the end rolls is to be adapted to the web thickness, because the bending stress in the web is directly proportional to the web thickness and reciprocally proportional to the roll diameter. A suitable dimension of the rolls can be a diameter of about 2 m.

The aperture size is to be adjusted to the pulp to be treated, but should be in the interval of 0.5–1.5 mm diameter. It is, of course, also imaginable to design the apertures as slits. The open area should under all conditions amount to between 8% and 25%.

The length and width of the web are not critical, but can be adapted as desired. The width desired, thus, can be obtained by the longitudinal welding of a number of narrow webs to a wider one, because it is not possible to directly manufacture steel webs with such widths as concerned here, for example of about 6 m. Steels webs normally are not manufactured in widths exceeding a full meter.

The vacuum containers 8 are attached detachably in the stand 4 by means of shoulders 23 and are arranged so as to be capable to be lowered individually to a level below their mounted position. In that case the outlets 10 are dismantled. The stand, further, is open in the longitudinal direction on that level which corresponds to the lowered position of the containers 8, whereby the containers can be moved in the longitudinal direction of the stand. A special carriage 21 can be provided in the stand 4 for this movement, which carriage 21 can be movable along grooves 22 in the stand. All containers can hereby be taken out in lateral direction in a suitable place along the stand 4. This implies essential advantages, because the active part of the web can be up to 30 m long, and in certain cases still longer. As no space is required to the side of the apparatus for web exchange, the apparatus according to the invention scarcely requires more space than needed for its own length and width. Only in one position along the stand of the apparatus is extra width required for the removal of all vacuum containers. This implies, for example, great freedom in positioning the apparatus in a room where there is lack of space in general and every square meter is valuable.

The invention is not restricted to the embodiment shown, but can be varied within the scope of the invention idea.

I claim:

1. An apparatus for liquid treatment of pulp, said apparatus comprising a stand having an upper support and a lower support, a liquid-permeable web having a longitudinal axis, means for supporting said web within said stand, means for supplying pulp to said web, a plurality of containers arranged in an upper position adjacent an underlying portion of said web for collecting liquid penetrating said web, said containers removably supported by said upper support of said stand and extending transversely of the longitudinal axis of said web and across substantially the entire width thereof, said containers structured in relationship to said stand to be individually lowerable from said upper position to a lower position movable along the longitudinal axis of said web to a predetermined location within said stand, and moving means for moving said containers along the longitudinal axis of said web when in said lower position, said moving means supported by said lower support of said stand, said stand being constructed and arranged in relationship to said containers to permit the movement of said containers, when in said lower position, along the longitudinal axis of said web and underlying said containers being supported in said upper position by said upper support of said stand, whereby selected ones of said containes can be individually removed from said stand at said predetermined location.

2. The apparatus of claim 1, wherein said means for supporting said web comprises a pair of spaced-apart rollers supported by said stand.

3. The apparatus of claim 1, wherein said stand is further constructed and arranged to permit the removal of said containers at said predetermined location along an axis transverse to the longitudinal axis of said web.

4. The apparatus of claim 3, wherein said means for moving said containers comprises a carriage.

5. The apparatus of claim 1, wherein said stand includes space-apart shoulders for removably supporting the ends of said containers in said upper position, while permitting the lowering of said containers from said upper position to said lower position.

6. The apparatus of claim 1, wherein said web comprises a perforated steel web.

7. The apparatus of claim 1, wherein said predetermined location comprises one end of said stand.

8. The apparatus of claim 1, further including means for supplying a treatment liquid to said pulp.

* * * * *